US009768528B2

(12) United States Patent
Lucantonio

(10) Patent No.: US 9,768,528 B2
(45) Date of Patent: Sep. 19, 2017

(54) POWER CABLE IN-LINE POWER OUTLET

(71) Applicant: LUCANTONIO FAMILY TRUST NO. 2, West Hoxton (AU)

(72) Inventor: Dean Lucantonio, West Hoxton (AU)

(73) Assignee: Lucantonio Family Trust No. 2, West Hoxton (AU)

( * ) Notice: Subject to any disclaimer, the term of this patent is extended or adjusted under 35 U.S.C. 154(b) by 177 days.

(21) Appl. No.: 14/425,201

(22) PCT Filed: Sep. 3, 2013

(86) PCT No.: PCT/AU2013/000995
§ 371 (c)(1),
(2) Date: Apr. 24, 2015

(87) PCT Pub. No.: WO2014/032123
PCT Pub. Date: Mar. 6, 2014

(65) Prior Publication Data

US 2016/0344111 A1 Nov. 24, 2016

(30) Foreign Application Priority Data

Sep. 3, 2012 (AU) ..... 2012216570

(51) Int. Cl.
*H01R 4/24* (2006.01)
*H01R 24/76* (2011.01)
*H01R 25/16* (2006.01)
*H01R 24/78* (2011.01)

(52) U.S. Cl.
CPC ..... *H01R 4/2412* (2013.01); *H01R 24/76* (2013.01); *H01R 24/78* (2013.01); *H01R 25/164* (2013.01)

(58) Field of Classification Search
CPC ..... H01R 4/2412; H01R 24/76; H01R 24/78; H01R 25/164
USPC ..... 439/393
See application file for complete search history.

(56) References Cited

U.S. PATENT DOCUMENTS 4,941,844 A * 7/1990 Bowden ..... H01R 4/2412 439/35
4,995,829 A * 2/1991 Geib ..... H01R 4/2433 439/409
5,681,179 A * 10/1997 Lane ..... H01R 4/2404 439/393
5,704,801 A * 1/1998 Walker ..... H01R 12/675 439/417
5,769,654 A * 6/1998 Onoda ..... H01R 4/2466 439/393

(Continued)

*Primary Examiner* — Abdullah Riyami
*Assistant Examiner* — Nader Alhawamdeh
(74) *Attorney, Agent, or Firm* — Martensen IP

(57) ABSTRACT

A power cable in-line power outlet (and associated method of use); said outlet including at least two sockets or slots for receiving power conducting pins of a plug of a powercord; said sockets or slots providing access to connector elements engaging with corresponding power conducting elements of said power cable; said power cable comprising an outer insulating sheath enclosing separate insulating sheaths of each said at least two power conducting elements; said power cable urged into cutting contact with said connector elements by rotation of a cam-lever from an initial non-contacting position to a position in which each of said power conducting elements of said power cable are in contact with said connector elements.

19 Claims, 17 Drawing Sheets

(56) References Cited

U.S. PATENT DOCUMENTS

| | | | | |
|---|---|---|---|---|
| RE45,456 | E * | 4/2015 | Sinclair | H01R 25/142<br>439/111 |
| 2012/0135632 | A1* | 5/2012 | Maher | H01R 12/67<br>439/393 |
| 2013/0097812 | A1* | 4/2013 | Sanders | H01R 13/639<br>24/115 R |

* cited by examiner

POWER CABLE IN-LINE POWER OUTLET

TECHNICAL FIELD

The present invention relates to electrical power reticulation and, more particularly, to the provision of power outlet sockets along a power reticulation cable.

BACKGROUND

It is common to provide power outlets along some point of an electrical reticulation cable for the connection of appliances. Although such outlets may be provided with on/off switches to control power flow to the appliance, in many cases this is not required. Nevertheless, the installation of these outlets is an awkward and time consuming process, especially where an outlet is required in an existing power cable.

Power cables typically comprise a relatively thick polymer outer insulating sheath enclosing at least two (active and neutral) side by side power conducting elements, each enclosed in its own separate polymer insulating sheath. Earthed power supply cables will additionally provide an earth conducting element also enclosed in a polymer insulating sheath and lying between the active an neutral elements.

To install a conventional power outlet, the power cable must be cut and the outer insulating sheath removed from the two ends of the cut cable. Sufficient of the insulating sheaths of the two, or in the case of an earthed supply, three conducting elements must then be stripped, again from the two exposed ends, to allow the bare conducting elements to be connected to the respective connectors of the power outlet.

Apart from being time consuming and requiring the used of several different tools, there is always a danger of incorrectly connecting the ends of the conductors to the connectors of the outlet. There is also a risk that the action of removing the outer insulation with inappropriate tools may cut into and degrade the insulation of the conducting elements.

Non-switched power outlets are known which obviate at least some of the above disadvantages. Thus AU200242444 B2 discloses a power outlet which may be installed on a power cable without cutting the cable. A disadvantage of the arrangement disclosed in this patent however is that the heavy outer insulating sheath must be removed. This is particularly difficult to do if the cable is an existing one, typically stretched tight and clipped to some supporting surface. The difficulty is exacerbated by the risk of cutting into and damaging the insulation of the conducting elements and even the conducting elements themselves.

In non-power outlet devices such as cable connectors, insulation displacement arrangements in which both an outer insulating sheath and inner insulation are cut to bring the conductor into contact with the cutting elements are known. Thus for example the USPTO Classes include class 439/409 "Pivoting cutter, pivoting means to operate cutter or pivoting means to move conductor against cutter."

An examples of such a device is U.S. Pat. No. 7,942,689 which discloses "a wire carrier and a base. Pierce points on the base are, slid along opposed walls in a slot in the carrier to align small tips on the ends of the pierce points to form electrical connections with a conductor in a wire in the carrier". Another example is found in U.S. Pat. No. 7,144,269 in which cutting blades are rotated about a pivot point to cut through outer and inner insulation to come into electrical contact with each of three conductor cores.

It is an object of the present invention to address or at least ameliorate some of the above disadvantages.

Notes

The term "comprising" (and grammatical variations thereof) is used in this specification in the inclusive sense of "having" or "including", and not in the exclusive sense of "consisting only of".

The above discussion of the prior art in the Background of the invention, is not an admission that any information discussed therein is citable prior art or part of the common general knowledge of persons skilled in the art in any country.

SUMMARY OF INVENTION

Accordingly, in one broad form of the invention, there is provided a power cable in-line power outlet; said outlet including at least two sockets or slots for receiving power conducting pins of a plug of a power cable; said sockets or slots providing access to respective electrically conducting connector elements engaging with corresponding power conducting elements of said power cable; said power cable comprising an outer insulating sheath enclosing separate insulating sheaths of each said at least two power conducting elements; said connector elements passing through said outer insulating sheath and respective said separate insulating sheaths of said at least two power conducting elements; said connector elements urged into cutting contact with said outer insulating sheath and thence respective said separate insulating sheaths and thence each of said at least two power conducting elements by rotation of at least a component of the power cable in-line power outlet.

Preferably rotation of at least a component comprises rotation of a cam-lever from an initial non-contacting position to a position in which each of said power conducting elements of said power cable are in contact with said connector elements.

In yet a further broad form of the invention there is provided a method of assembling an in-line power outlet to an electric power cable; said power cable comprising at least first and second conductor elements; each said conductor element provided with a separate insulating sheath; said conductor elements and said insulating sheaths enveloped by an outer insulating sheath; said method including the steps of:

(a) arranging said power cable so that said outer insulating sheath lies between side portions of a cable guide element of said in-line power outlet, (b) closing a back portion of a housing of said in-line power outlet, (c) pivoting at least a component of the power outlet from a first non pressure inducing position to a second pressure inducing position, and whereby said power cable is urged against insulation piercing points of connector blades so as to force said connector blades through said outer insulating sheath and said separate insulating sheaths of said power conducting elements into contact with respective ones of said at least first and second conductor elements.

Accordingly, in a further broad form of the invention, there is provided a power cable in-line power outlet; said outlet including at least two sockets or slots for receiving power conducting pins of a plug of a power cord; said sockets or slots providing access to connector elements engaging with corresponding power conducting elements of said power cable; said power cable comprising an outer insulating sheath enclosing separate insulating sheaths of each said at least two power conducting elements; said connector elements passing through said outer insulating sheath and respective said separate insulating sheaths of said at least two power conducting elements; said power cable urged into cutting contact with said connector elements by rotation of a cam-lever from an initial non-contacting position to a position in which each of said power conducting elements of said power cable are in contact with said connector elements.

Preferably, said power cable is a three conductor element cable; an active conductor element, a neutral conductor element and an earthing conductor element; said conductor elements arranged side by side with said earthing conductor element flanked by said active and said neutral conductor elements.

Preferably, said power outlet includes a housing comprising a front portion and a back portion; said front portion provided with said sockets for receiving said power conducting pins of a said electrical appliance.

Preferably, said connector elements comprise power conducting clips for engaging with said power conducting pins; said connector elements further comprising rearward projecting connector blades.

Preferably, said power outlet includes a cable guide; said cable, guide including side portions for receiving therebetween a said power cable; slots in a base portion of said cable guide determining spacing of said rearward projecting connector blades; said spacing diverging from a first spacing of said connector blades for spacing of power conducting elements of a first cable specification to a second spacing, for power conducting elements of a second cable specification.

Preferably, said power conducting clips are supported in sockets provided on a chassis element of said power outlet; said rearward projecting connector blades of said power conducting clips arranged so as to pass through slots arranged side by side in a base portion of said chassis element.

Preferably, said rearward projecting connector blades pass through respective said slots of said cable guide when said cable guide is located in said chassis element.

Preferably, said rearward projecting connector blades are provided with insulation piercing points.

Preferably, said cable guide is retained in one of at least two positions within said chassis element of said power outlet; a first position arranged so that spacing of said rearward projecting connector blades conforms to conductor spacing of said first cable specification; a second position arranged so that spacing of said rearward projecting connector blades conforms to conductor spacing of said second cable specification.

Preferably, said cable guide is slidably adjustable between said first and second positions.

Preferably, said side portions of said cable guide are flexibly connected to said base portion of said cable guide; retaining elements of said chassis element arranged so that spacing of said side portions adjacent said rearwardly projecting connector blades conforms to overall width of a said cable of either said first or said second cable specification in accordance with said first or second position of said cable guide in said chassis element.

Preferably, said base portion of said cable guide moves relative said connector blades when said cable guide is moved from said first to said second position; movement of said base portion compensating for differences in thickness of said first and said second cable specification.

Preferably, said chassis element is affixed to said front portion of said housing; said chassis element provided with hinge and snap-locking elements for engagement with complementary hinge and snap-locking elements of said back portion of said housing.

Preferably, said back portion of said housing is provided with a pivoting cam lever; said cam lever pivoting from a first non pressure inducing position to a second pressure inducing position; a cam portion of said cam lever forcing said power cable against said insulation piercing points of said rearward projecting connector blades to bring said blades into contact with respective conductor elements of said power cable.

Preferably, said first and second cable specifications comprise conductor elements of 1.5 mm and 2.5 mm cross sectional areas respectively.

In another broad form of the invention, there is provided a method of assembling an in-line power outlet to an electric power cable; said power cable comprising at least first and second conductor elements; each said conductor element provided with a separate insulating sheath; said conductor elements and said insulating sheaths enveloped by an outer insulating sheath; said method including the steps of:

(a) arranging said power cable so that said outer insulating sheath lies between side portions of a cable guide element of said in-line power outlet, (b) closing a back portion of a housing of said in-line power outlet, (c) pivoting a cam lever from a first non pressure inducing position to a second pressure inducing position, and wherein a cam portion of said cam lever forces said power cable against insulation piercing points of connector blades so as to force said connector blades through said outer insulating sheath and said separate insulating sheaths of said power conducting elements into contact with respective ones of said at least first and second conductor elements.

Preferably, said method includes a prior step of locating said cable guide element within said housing in accordance with a first or second cable specification.

Preferably, said connector blades project through slots in a base portion of said cable guide; said slots diverging from a first spacing conforming to conductor element spacing of said first cable specification to a second spacing conforming to conductor element spacing of said second cable specification.

Preferably, said cable guide element is slidably located within a chassis element of said power outlet; said chassis element affixed to a front portion of said housing.

Preferably, said housing comprises said front portion and said back portion; said back portion connected to said chassis element by cooperating hinge portions of said chassis and said back portion; said back portion locked against said front portion by cooperating snap elements of said chassis element and said back portion.

Preferably, said front portion is provided with sockets for receiving power conducting pins of an electrical appliance; said sockets providing access to pin engaging clips; said clips integral with said connector blades.

In another broad form of the invention, there is provided a method of connecting a power outlet to a power cable without removal of insulation from said power cable; said power outlet including power conducting sockets for receiving power conducting pins of an electrical appliance; said method including the steps of:

(a) arranging said power cable to lie within an adjustable cable guide within a housing of said power outlet, (b) closing a back portion of said housing against a front portion of said housing, (c) pivoting a cam lever from a non pressure inducing position to a pressure inducing position, and wherein a cam portion of said cam lever forces said power cable against insulation piercing connector blades projecting through slots in a base portion of said cable guide; conducting elements of said power cable forced into contact with said connector blades.

In another broad form of the invention a power outlet assembly for receiving at least one plug of a power cord; said power outlet assembly receiving power from a power cable; said power outlet assembly including a power cable locating passage and rearwardly projecting insulating cutting blades disposed within said power cable locating passage; said assembly including a primary cable clamping lever and a cam lever; axis of said primary clamping lever and said cam lever being parallel to an axis of said power cable in said power cable passage.

Preferably, said power cable is a three conductor power cable; said conductors comprising an active conductor, a neutral conductor and an earth conductor; said conductors disposed side by side within an outer insulating sheath of said power cable; each of said conductors further enclosed within respective inner insulating sheaths.

Preferably, said primary clamping lever retains said power cable in said power cable passage when said primary clamping lever is rotated into a closed snap-locked position against a rear plate of said assembly.

Preferably, said primary clamping lever includes an integrally attached flexible pressure plate; said pressure plate arranged to lie against said power cable in said power cable passage when said primary clamping lever is rotated from a first open position to said snap-locked position against a rear plate of said assembly.

Preferably, a surface of said cam lever is progressively urged against said flexible pressure plate when said cam lever is rotated from a first open position to a snap-locked position relative said primary clamping lever; said surface driving said power cable against said rearward projecting blades so as to cause respective said blades to pierce through said outer insulating sleeve and respective ones of said active conductor, said neutral conductor and said earth conductor; respective said blades making electrical contact with said conductors.

Preferably, respective ones of said rearwardly projecting blades are part of conductor elements mounted to a chassis plate of said assembly; said conductor elements provided with connector elements for receiving respective active, neutral and earth pins of a said plug of a power cord.

Preferably, said power cable locating passage includes structures defining said cable locating passage; said structures adapted to retain a stop plug; said stop plug provided with sockets to accept end portions of each of said active conductor, said neutral conductor and said earth conductor when said outer sheath and said respective inner insulating sheaths have been removed from said conductor.

Preferably, said assembly is a switched double power outlet.

In another broad form of the invention, there is provided a method of connecting a power outlet assembly along a length of power cable without removal of insulation of said power cable; said method including the steps of:

placing a said power cable along a power cable passage of said power outlet assembly, rotating a primary clamping lever from an initial open position into a snap-locked position against a rear plate of said assembly to secure said power cable within said power cable passage, rotating a cam lever from an initial open position into a snap-locked position relative said primary clamping lever to force said power cable into insulation cutting contact with insulation piercing rearwardly projecting blades; said blades communicating with connector elements, for receiving respective active, neutral and earth pins of a plug of a power cord.

BRIEF DESCRIPTION OF DRAWINGS

Embodiments of the present invention will now be described with reference to the accompanying drawings wherein.

DESCRIPTION OF EMBODIMENTS

First Preferred Embodiment

Figure 1:
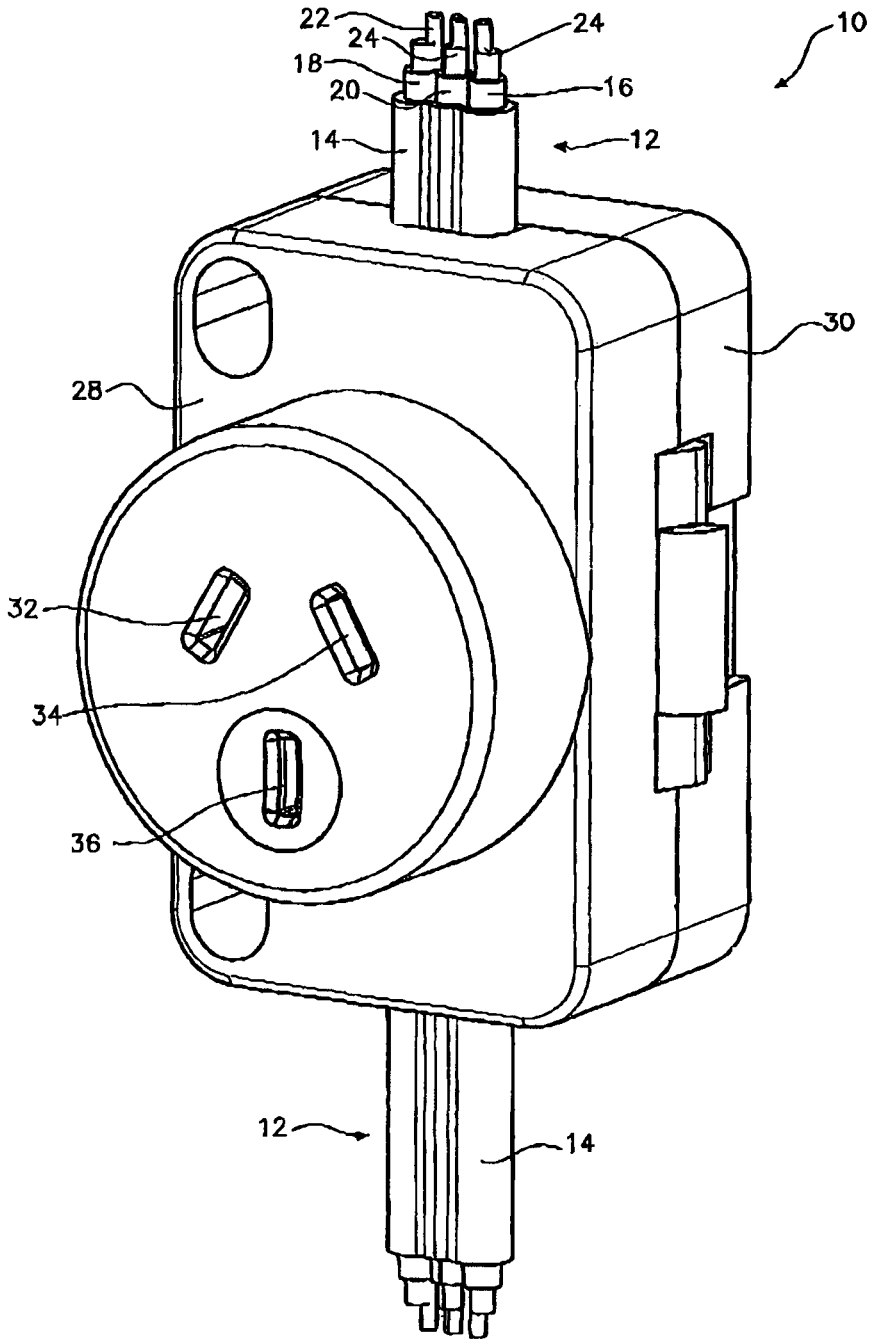
FIG. 1 is a front view of a preferred embodiment of a power cable in-line power outlet assembly according to the invention.

With reference firstly to FIGS. 1 to 4, the power cable in-line power outlet 10 of the present invention provides for an un-switched power outlet which may be attached to a power cable 12 without the use of any tools or the need to remove any of the outer insulation sheath 14 or separate insulation sheaths 16, 18 or 20 of the power cable conductors.

Preferably the power outlet 10 provides for a three conductor cable 12 including an active conductor element 22, a neutral conductor element 24 and an earthing conductor element 26 with the conductor elements arranged side by side with the earthing conductor element 26 flanked by the active and the neutral conductor elements 22 and 24.

The power outlet 10 includes a housing comprising a front portion 28 and a back portion 30. The front portion 28 is provided with sockets 32, 34 and 36 for receiving power conducting pins (not shown) of an electrical appliance. Electrical appliances may include extension leads or electrical devices which may be directly coupled to the power outlet 10. The sockets 32 to 34 provide access to power conducting clips 38, 40 and 42 (as best seen in FIGS. 2, 2A and 7) for engaging with the power conducting pins of an appliance.

Figure 2:
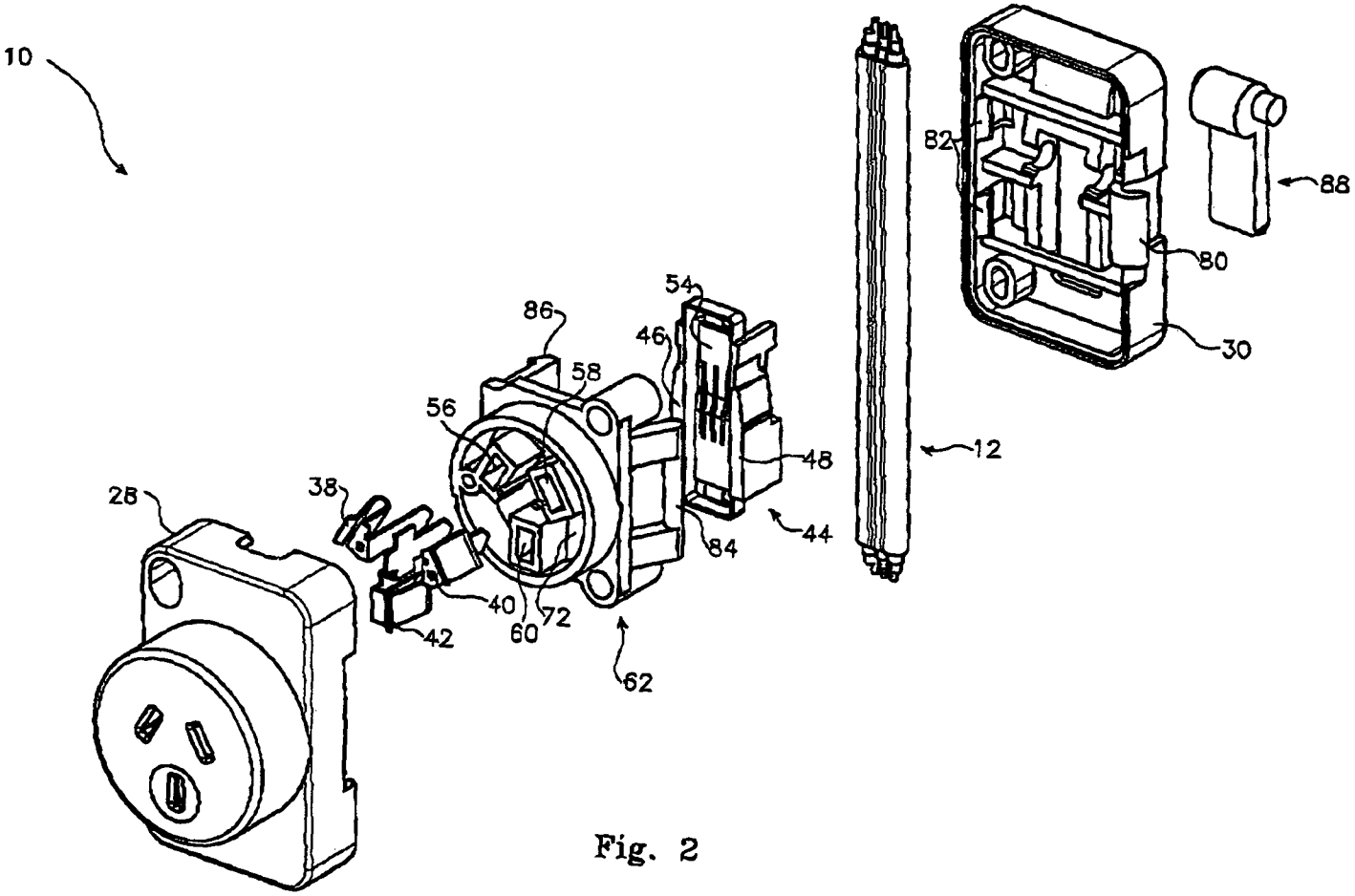
FIG. 2 is an exploded view of the power outlet assembly of FIG. 1.
Figure 2A:
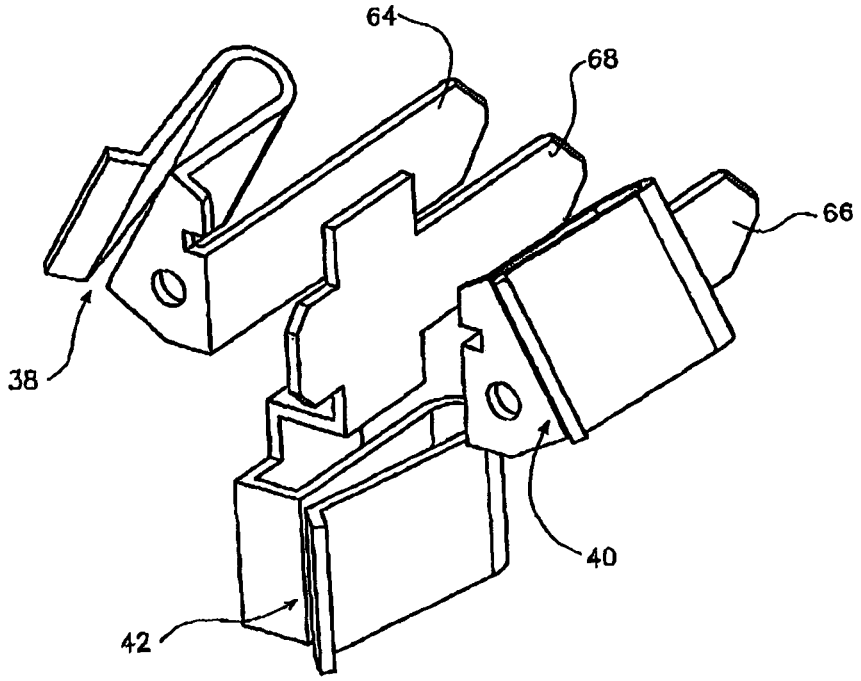
FIG. 2A is an enlargement of connector clips shown in FIG. 2.
Figure 4:
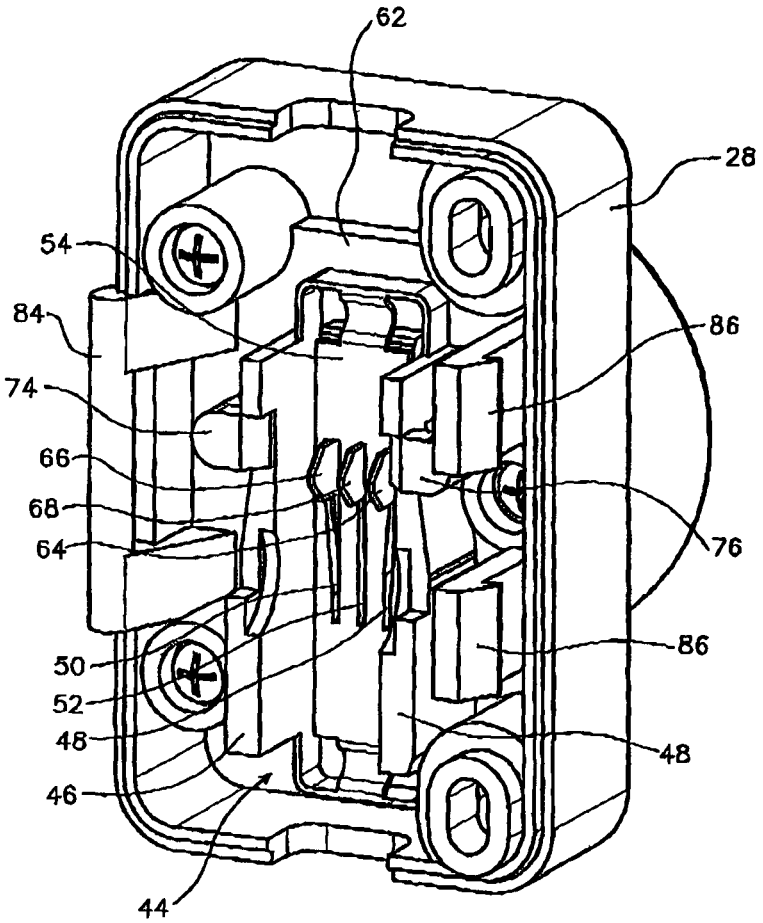
FIG. 4 is a view of the front portion of the housing of the power outlet assembly of FIGS. 1 to 3 with the back portion removed showing, the chassis element, power cable guide element and connector elements.
Figure 5:
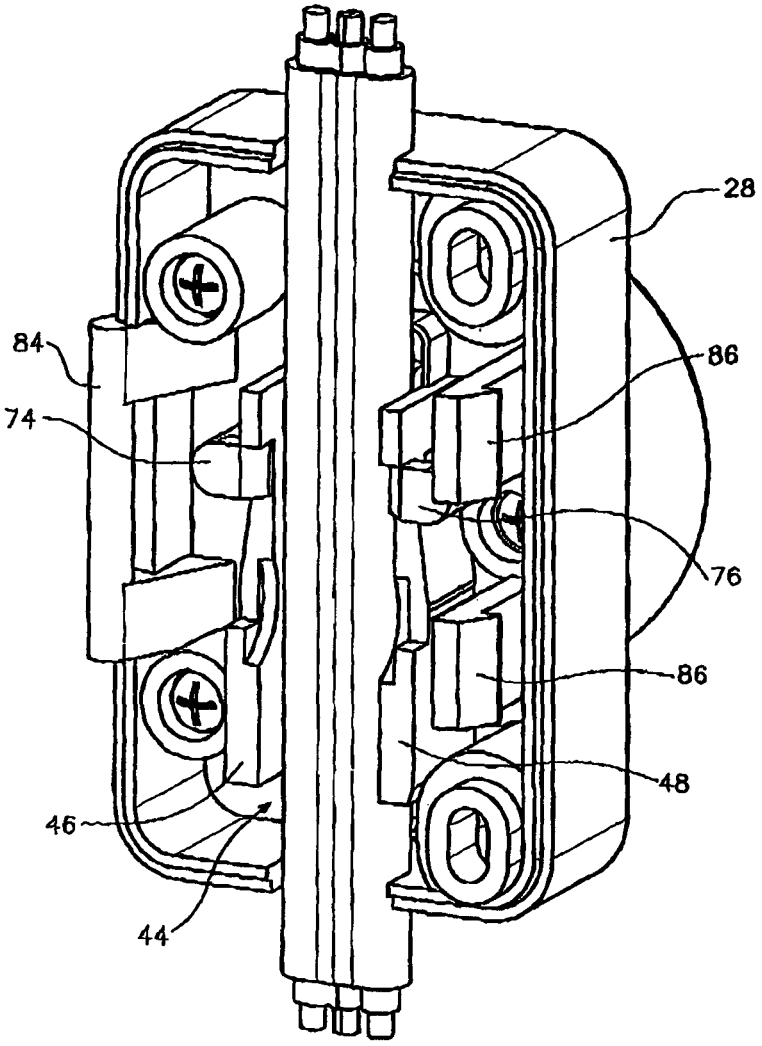
FIG. 5 is a view of a power cable in position within the power cable guide element of FIG. 4 with the back portion of the housing and cam lever removed.

Power outlet 10 includes a cable guide 44, shown in FIGS. 2, 4, 5 an 6, retained between support posts 74 and 76 of a chassis element 62. Cable guide 44 includes side portions 46 and 48 for receiving therebetween a power cable 12. Slots 48, 50 and 52 in a base portion 54 of the cable guide 44, diverge from a first narrower spacing at the lower end of the slots as seen in FIG. 4, to a wider spacing at the upper end. These first and second spacings conform to the spacing of the conducting elements 22, 24 and 26 of power cables according to at least two cable specifications of cables to which the power outlet 10 may be applied.

Preferably, the power outlet 10 provides for first and second cable specifications covering conductor elements of 1.5 mm and 2.5 mm cross sectional areas respectively.

Figure 7:
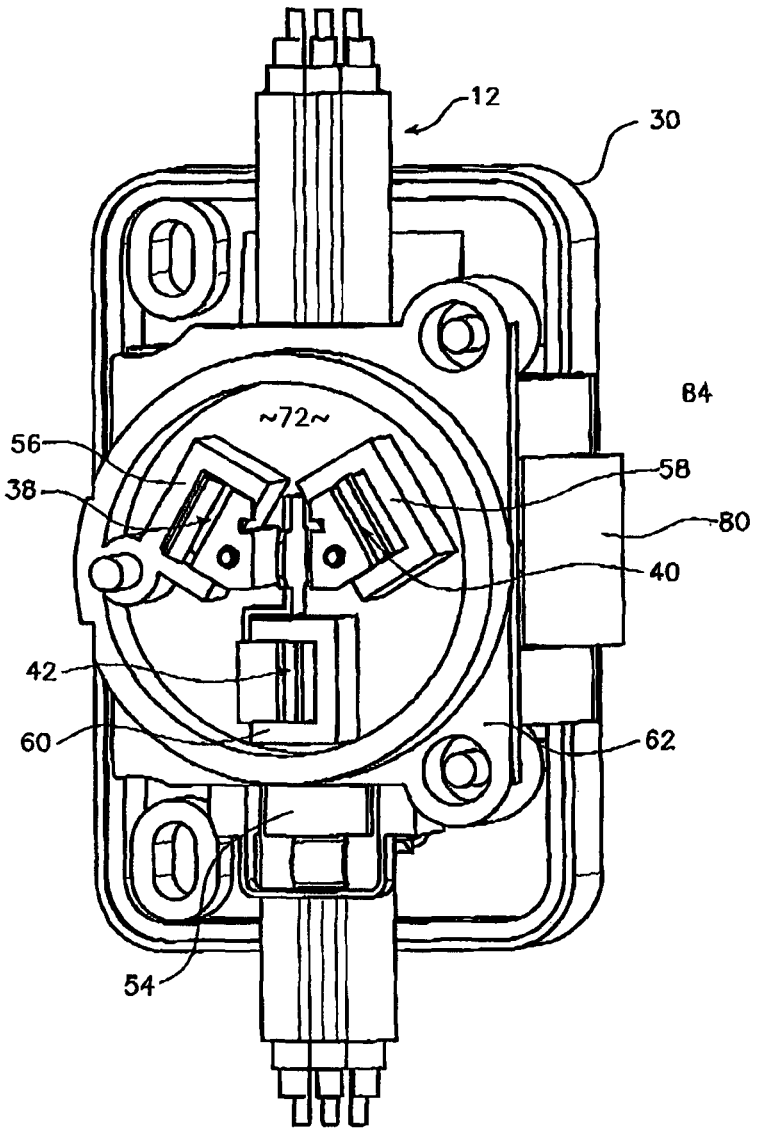
FIG. 7 is a further view of the power outlet assembly of FIG. 1 with the front portion of the housing removed showing the power conducting clips and connector elements.

As best seen in FIG. 7, the power conducting clips 38, 40 and 42 are supported in sockets, 56, 58 and 60 provided on the chassis element 62 fixed within the front portion 28 of the housing. As best seen in the enlargement of FIG. 2A, each of the clips 38, 40 and 42 includes a rearward projecting connector blade, 64, 66 and 68 respectively. These pointed connector blades are arranged so as to pass, firstly through slots 70 arranged side by side in a base portion 72 of the chassis element 62 and thence through the slots 48, 50 and 52 in the base portion 54 of the cable guide 44.

Figure 6:
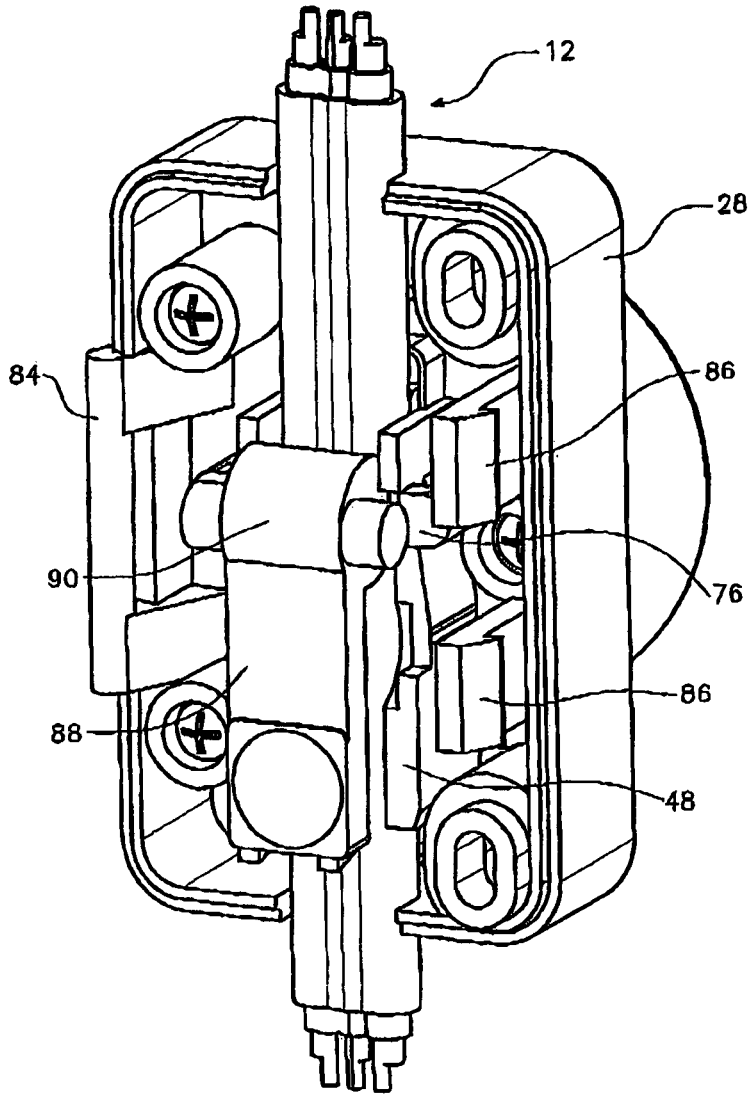
FIG. 6 is a further view of the arrangement of FIG. 5 showing the cam lever in a pressure applying position.

Cable guide 44 is retained in one of two positions between the support posts 74 and 76 of the chassis element 62. The first position, as shown in FIGS. 4 to 6 is arranged so that the spacing of the rearward projecting connector blades 64, 66 and 68, as controlled by the spacing of the slots 48, 50 and 52, conforms to the conductor spacing of the second cable specification. That is, the wider spacing is adapted to the spacing of the larger 2.5 $mm^2$ conductor elements. The second position (higher up relative the chassis element 62) is arranged so that spacing of the rearward projecting connector elements, again as controlled by the spacing of the slots, conforms to the narrower spacing of the smaller 1.5 $mm^2$ conductors of the first cable specification.

The side portions 46 and 48 of the cable guide 44 are flexibly connected to the base portion 54, allowing the separation between these side portions to vary. As best seen in FIG. 4, the side portions 46 and 48 vary in thickness so that the separation between the inside surfaces of the side portions varies depending on the location of the cable guide between fixed support posts 74 and 76. Thus, in the position of the cable guide 44 shown in FIG. 4, the separation between the side portions conforms to the overall width of the outer insulating sheath 14 of a power cable with the larger 2.5 $mm^2$ conductors. Moving the cable guide upwards, brings the thicker portions of the side portions 46 and 48 between the support posts 74 and 76, narrowing the separation to that of the outer sheath of a 1.5 $mm^2$ conductor cable.

The movement of the cable guide from the first position shown in FIG. 4, suited to the wider 2.5 $mm^2$ conductor cable to the second position for the smaller 1.5 $mm^2$ conductor cable, also moves the base portion 54 relative the connector blades 64-66 from forming a deeper channel to a shallower channel to adjust for the differences in thickness of the outer insulating sheaths.

Figure 8:
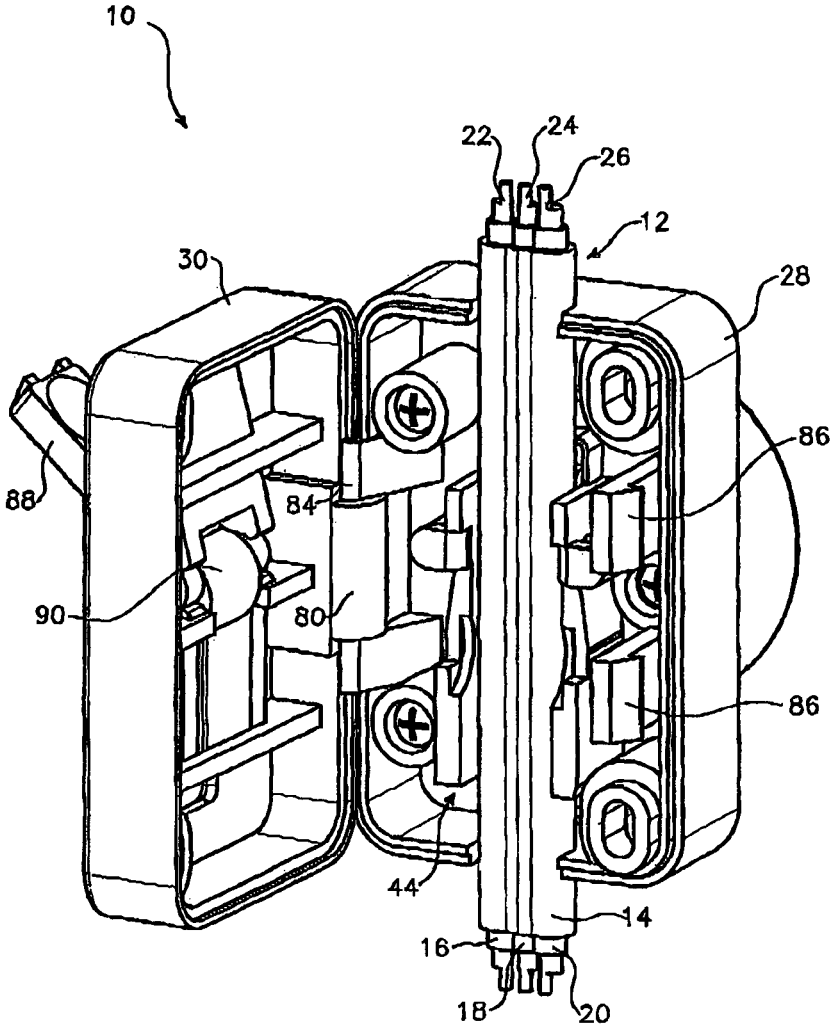
FIG. 8 is a rear view of the power outlet of FIG. 1 with the back portion opened.

Referring now to FIG. 8, back portion 30 of the housing of the power outlet 10, is provided with a hinge element 80 at one side of the back portion, and with snap locking elements 82 (visible in FIG. 2) at the opposite side. This hinge element 80 and snap locking elements 82 are adapted to engage with complementary chassis hinge element 84 and chassis snap locking elements 86 of the chassis element 62.

Figure 3:
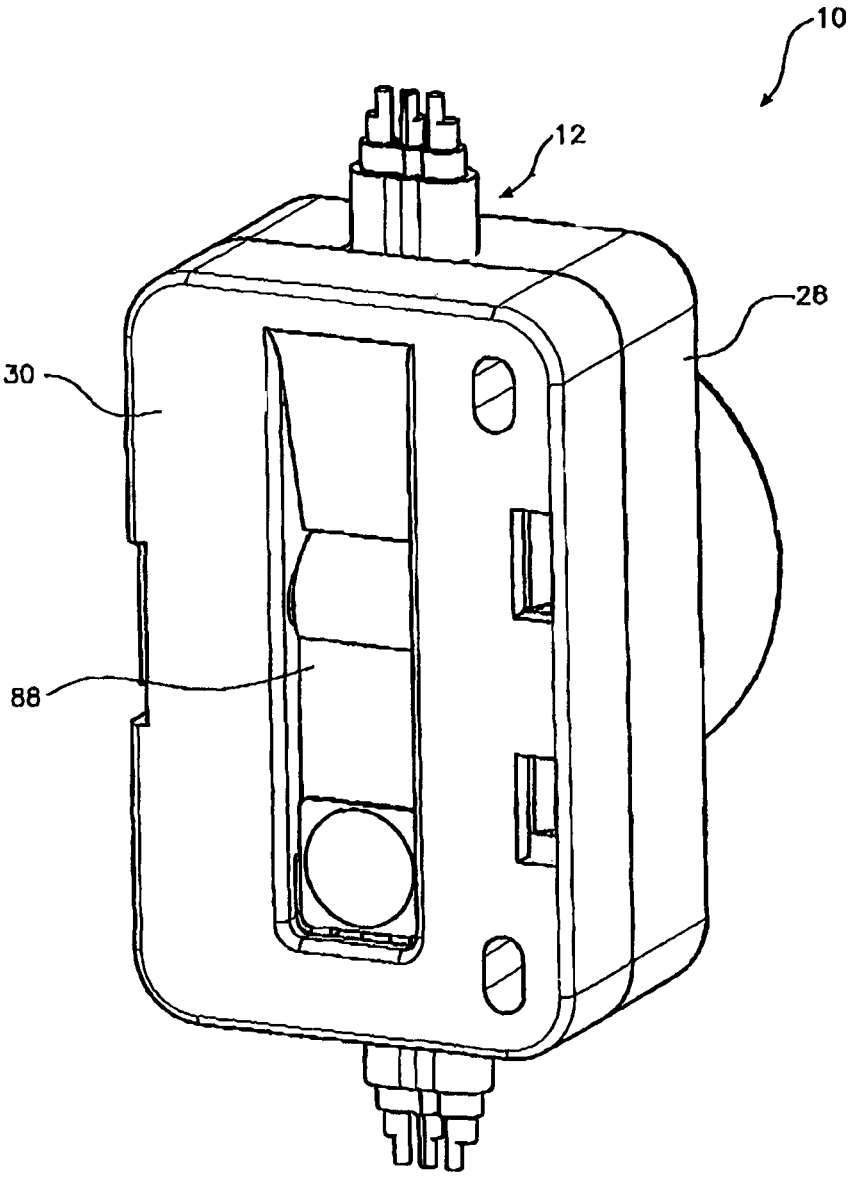
FIG. 3 is a rear view of the power outlet assembly of FIG. 1.

A cam lever 88 is pivotally located in rear portion 30 and may be rotated between the non pressure inducing position shown in FIG. 8 and the locked down, pressure inducing position shown in FIGS. 3 and 6. When the cable guide 44 has been adjusted to the required cable specification position and the outlet has been positioned around a power cable 12 with the cable lying in the cable guide, the back portion 30 of the housing is rotated about the hinge elements and snap-locked closed against the front portion 28.

The cam lever 88 is now rotated towards the position shown in FIG. 3, thereby driving the cam portion 90 against the cable 12, forcing it against the connector blades 64, 66 and 68 causing these to slice through the outer insulation sheath 14 and the separate insulation sheaths 16, 18 and 20 of the respective power conductor elements 22, 24 and 26. By this means the correctly spaced connector blades come into conducting contact with the power conductors of the cable to provide power to any appliance connected to the power outlet 10.

The apertures or cut-outs in the housing 28 which provide passage for the cable 12, are adapted to receive a stop plug (shown as feature 150 in FIG. 14 and provides for installation of the power outlet 10 as the last power outlet at the end of a power cable as more particularly described below.

Second Preferred Embodiment

Figure 9:
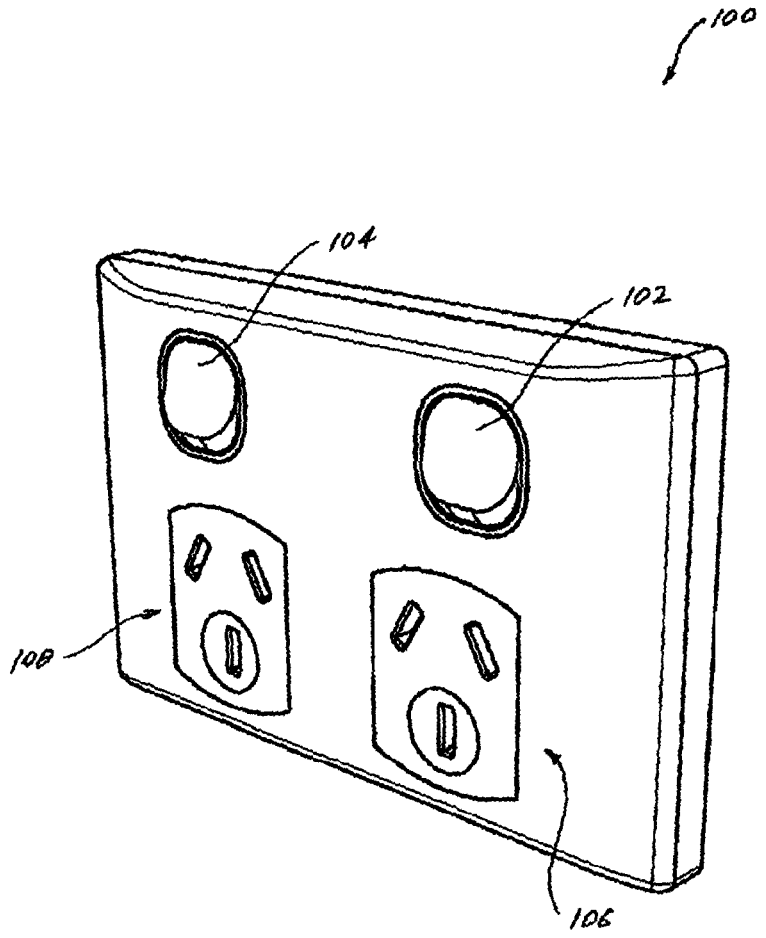
FIG. 9 is a perspective front view of a second preferred embodiment of a power outlet according to the invention.
Figure 10:
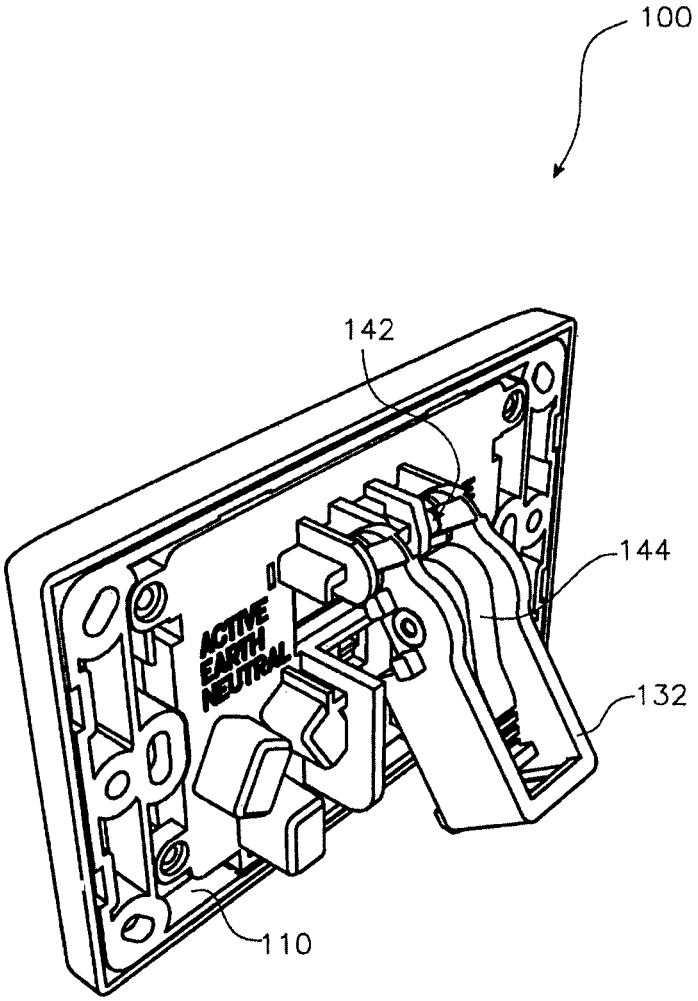
FIG. 10 is a perspective rear view of the power outlet of FIG. 9.

With reference now to FIGS. 9 to 16, a power outlet assembly 100 is provided with switches 102, 104 and groups of sockets or slots 106, 108 for receiving the pins (not shown) of a power cord plug (not shown). Preferably, though not necessarily, the power outlet as shown in FIG. 9 is a double power outlet providing power outlets and switches for two power cord plugs.

Figure 12:
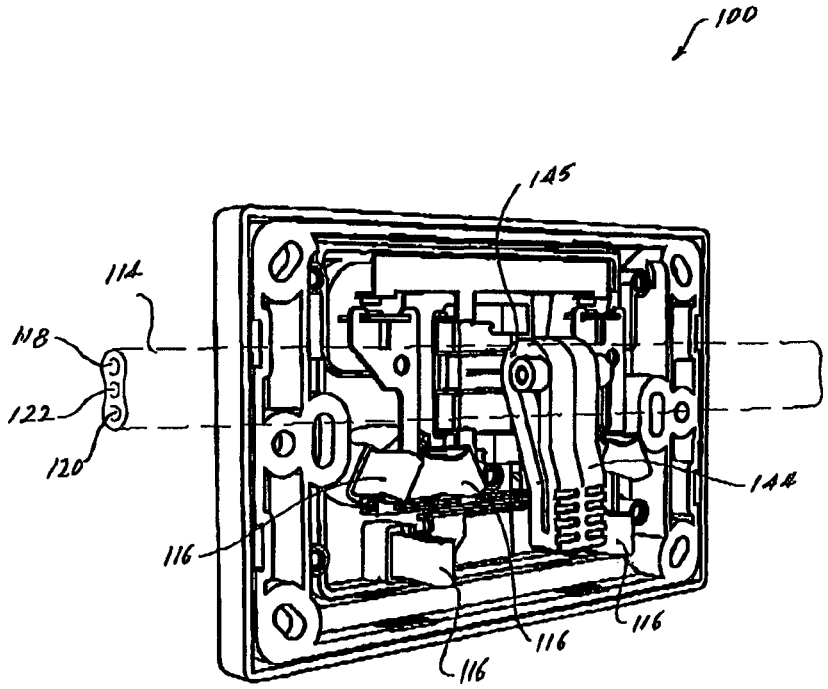
FIG. 12 is a further rear view of the power outlet of FIG. 9 showing the power distributing conductors and pin receiving clips.

Mounted to a chassis plate 110 as best seen in FIG. 12, are conductor elements 112 for respectively active, neutral and earth connections to a cable 114 of a power recirculation grid. Each conductor includes clips 116 located behind the slots 108 which accept the respective active, neutral and earth pins of electric power plugs. This arrangement of a power outlet is well known in the art. Also well known in the art is the connection of each of the conductors, active 118, neutral 120 and earth 122 of cable 114, after removal of the outer insulating sheath and sufficient of the inner insulation sheaths, by insertion into conductive receiving sockets and their securing by clamping screws.

In the present embodiment of the invention however, connection between the conductor elements, active 118, neutral 120 and earth 122 of cable 114, is not provided by receiving sockets and screwed retention but by rearwardly projecting blades 124, 126 and 128 (see FIGS. 11 and 13) which project from the respective conductor elements 112 for active, neutral and earth connection to the respective active, neutral and earth clips for each power outlet.

Figure 11:
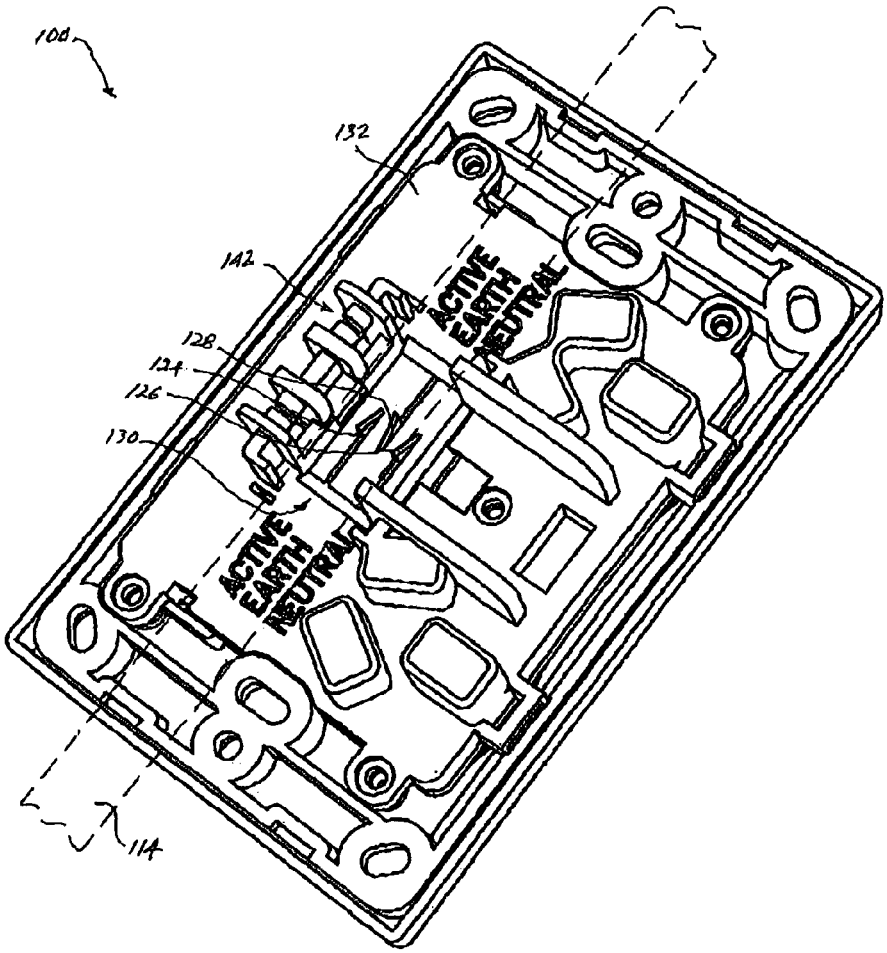
FIG. 11 is a further rear view of the power outlet of FIG. 9 with the primary clamping lever and cam lever removed.
Figure 13:
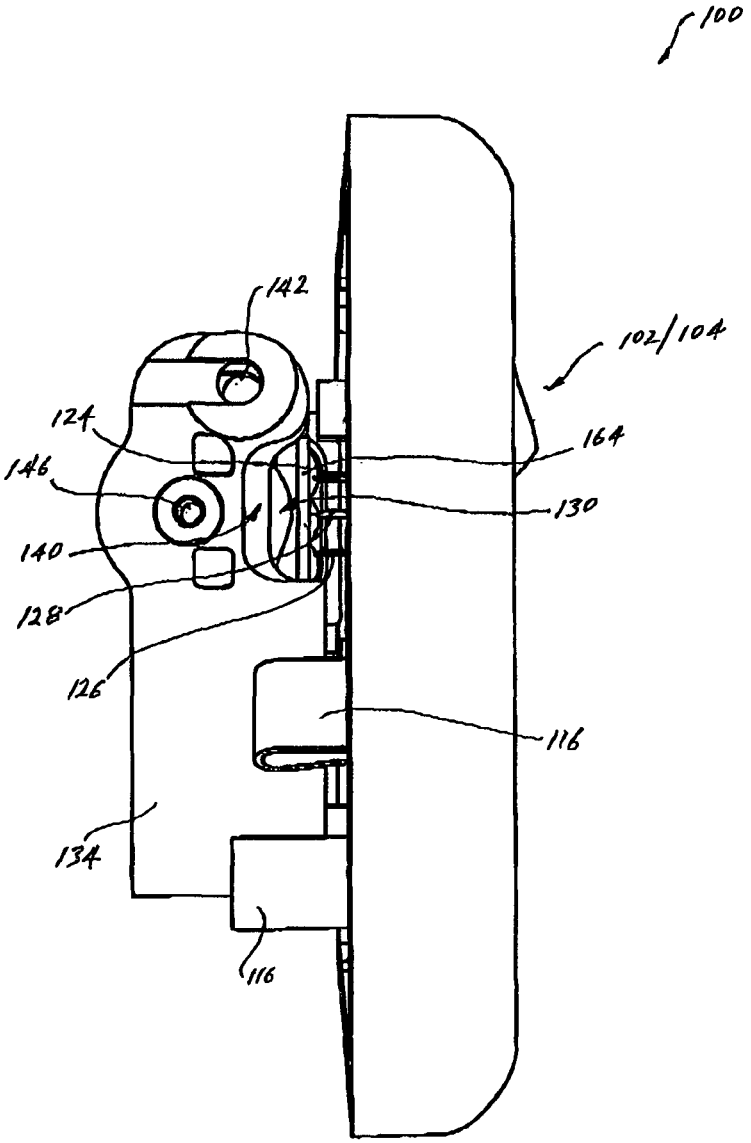
FIG. 13 is an end view of the power outlet showing a power cable passage and rearwardly projecting blades.

As best seen in FIGS. 11 and 13, the rearwardly projecting blades 124, 126 and 128 project into a power cable passage 130 in which power cable 114 is located. This passage 130 is defined in part by the projection structures of the rear plate 132 and the scalloped recesses 140 of the primary clamping lever 134 (removed from FIG. 11 for clarity). As perhaps best seen in FIGS. 10 and 13, primary clamping lever 134 pivots about an axis 142. When pushed into the position shown in FIGS. 13 and 14, the end of the primary clamping lever 134 is snap-locked to the rear plate 132, as shown in the cross section view of FIG. 16.

Figure 16:
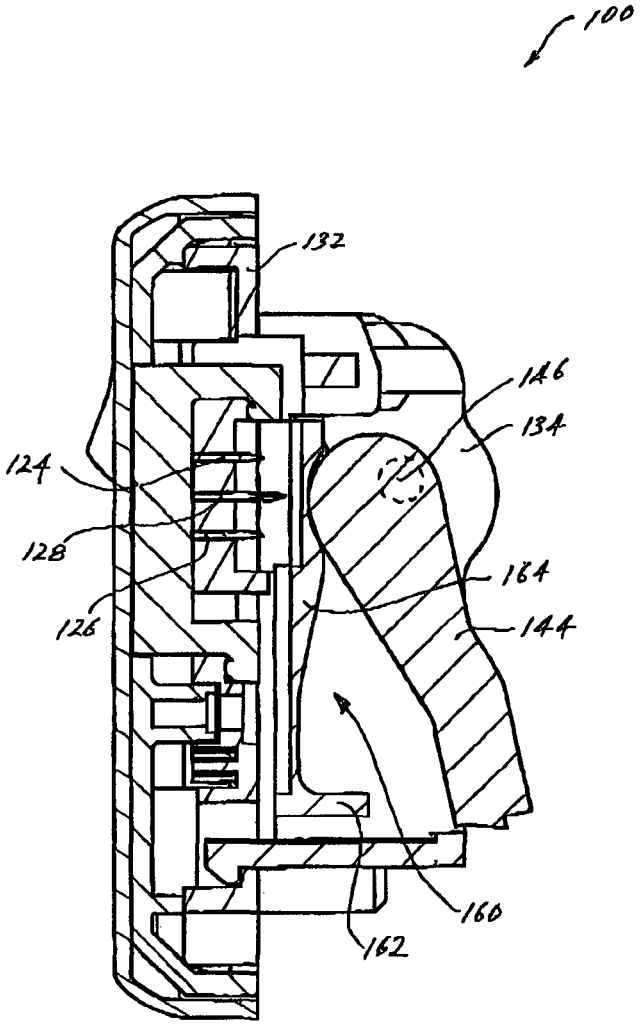
FIG. 16 is a cross section end view of the power outlet of FIGS. 9 to 15.

Still with reference to FIG. 16, primary clamping lever 134 is provided with a pressure element 160 comprising a base portion 162 integrally formed between the two side portions of the clamping lever 134, and a flexible pressure plate portion 164 extending upwardly from the base portion 162. Mounted within primary clamping lever 134 is a cam lever 144 pivoting about axis 146. Cam lever 144 is so arranged that that as it rotates downwardly, the cam surface 145 (see FIG. 12) moves inwards towards the rear plate 132.

As shown in the cross section view of FIG. 16, as cam lever 144 rotates about its axis 146, its surface engages with, and applies pressure to the pressure plate portion 164. This in turn is urged against the cable 114 (not shown in FIG. 16) to drive the cable against the rearwardly projecting blades 124, 126 and 128, forcing these blades through the cable outer and inner insulating sheaths.

Figure 14:
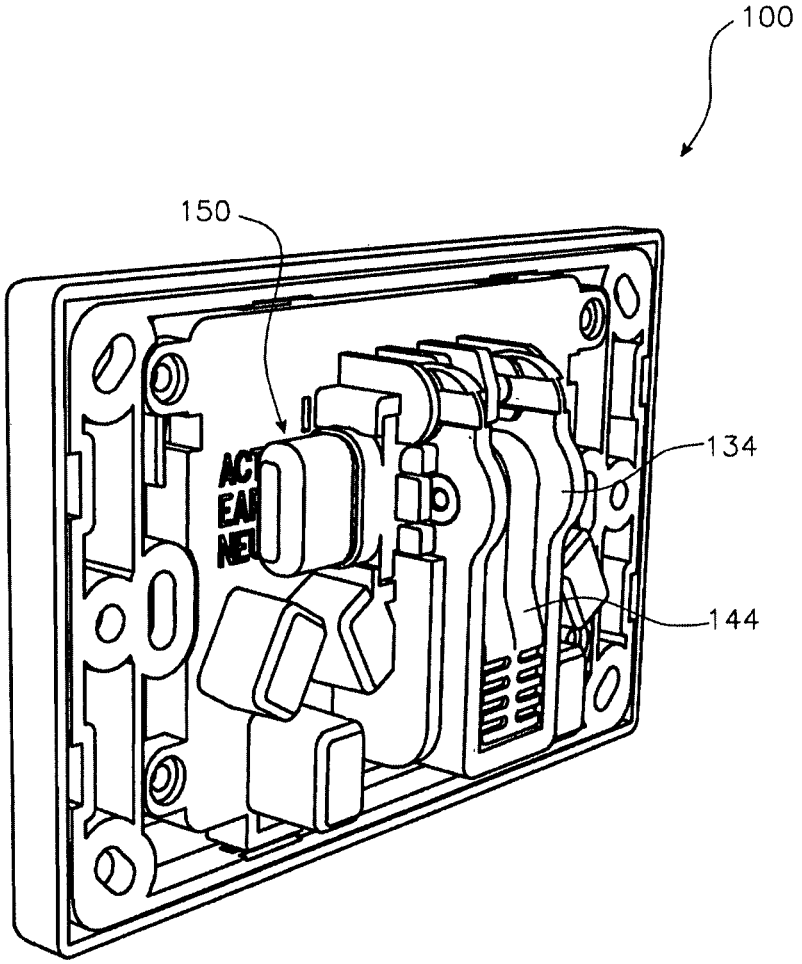
FIG. 14 is a further rear view of the power outlet showing an end stop for an end of the line installation.
Figure 15:
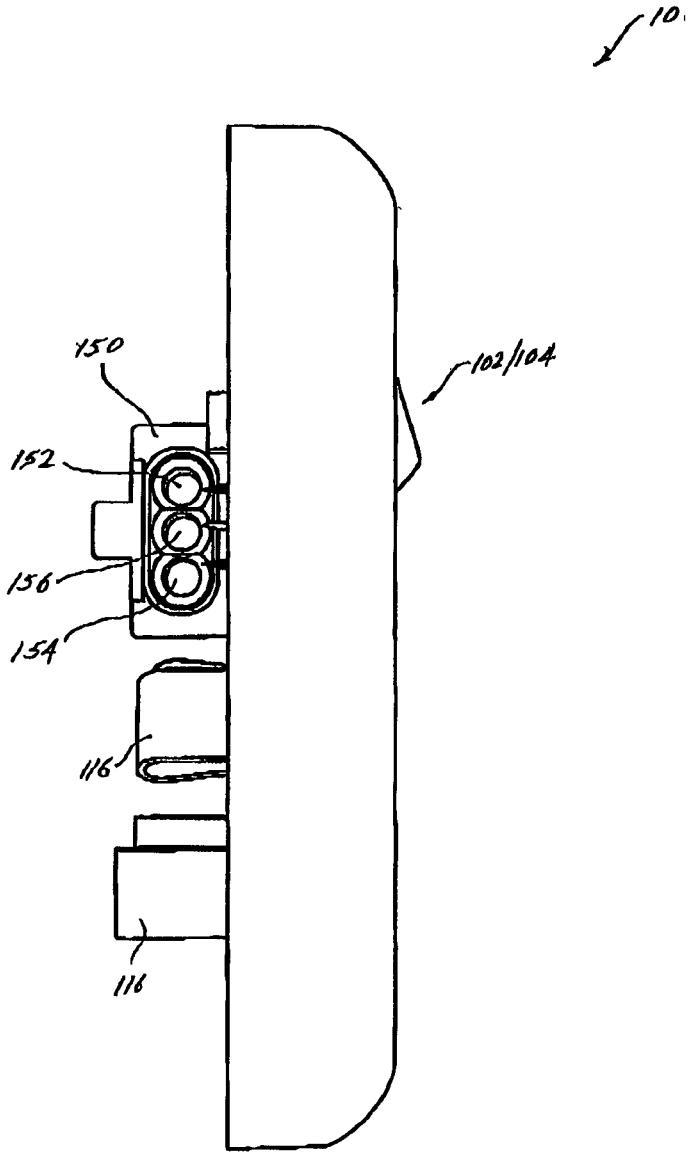
FIG. 15 is a second end view of the power outlet showing receiving sockets of the end stop of FIG. 14.

The projecting structures of the rear plate 132 are arranged so as to receive an optional stop plug 150 shown in FIG. 14. As shown in FIG. 15, stop plug 150 is provided with three sockets 152, 154 and 156 arranged to receive end portions of each of the active conductor, the neutral conductor and the earth conductor when short sections of the outer sheath and the respective inner insulating sheaths have been removed from the conductors at the outer end of the power cable.

The stop plug 150 allows the power outlet assembly of this embodiment also to be used at the end of a power cable. In this instance the power cable passes through the power cable passage 130 with the insulation sheaths intact in the region of the rearwardly projecting blades with the now bared conductor end portions protected and isolated within the respective sockets of the stop plug 150.

In Use

To connect power to the power outlet assembly 100 in series, both the primary clamping lever 134 and the cam lever 144 are rotated away from the rear plate 132 and a three core conductor cable 114 placed between the structures of the rear plate 132. The primary clamping lever 134 is then rotated down and snap-locked into the position shown in FIGS. 13 and 14 to securely locate the cable 114 within the passage 130. The cam lever 144 is now rotated downwards with the cam portion 150 pressing against the pressure plate 164 and hence forcing the cable 114 against the rearwardly projecting blades 124, 126 and 128. These blades then penetrate both the outer insulation sheath and the inner conductor insulation sheaths to contact the conductors 118, 120 and 122.

The power outlet assembly 100 may also be installed as the last power outlet in a series, or as a single power outlet. In that case, the end of the cable 114 is prepared by removing a short portion of the outer insulation sheath and inner insulating sheaths and these bared ends inserted into the stop plug of the invention.

INDUSTRIAL APPLICABILITY

The present invention provides a means of accessing power for in-series power outlets at intermediate points along a length of power cable of a power distribution circuit without the need to prepare that cable by removal of either the outer insulation or separate conductor insulation sheaths. No tools are required and the process is very rapid.

In respect of the First Preferred Embodiment described above, the power outlet of the invention is simply opened, the correct position of the cable guide of the invention selected for the cable type and the cable inserted into the cable guide. With the cam lever in its initial non pressure inducing position, the back portion of the power outlet housing is closed and locked against the front portion. Rotating the cam lever to lie flush with the back surface of the back portion, drives the conductor elements of the cable into contact with the blade elements connected to the power conducting pin clips of the front portion and the installation is complete.

In respect of the Second Preferred embodiment, for a power outlet in series, both the primary clamping lever and the cam lever are rotated away from the rear plate. The cable is positioned in the cable passage and clamped into position by rotating the primary clamping lever into its snap-locked position. The cam lever is then rotated into its snap-locked position forcing the cable onto the rearwardly projecting blades to make contact with the cable conductors.

In each of the above embodiments, the power outlet of the invention may be used at the end of a cable. In this instance a portion of the outer and inner sheaths of the cable are removed to expose a short portion of each of the conductors. These exposed ends are inserted into the respective sockets provided in the stop plug of the invention and the plug located into position on the rear plate of the assembly. The primary clamping lever and cam lever are then rotated into their locked positions as described above to complete the installation.

The invention claimed is:

1. A power cable in-line power outlet including at least two sockets or slots for receiving power conducting pins of a plug of a power cord wherein said sockets or slots provide access to connector elements engaging with corresponding power conducting elements of said power cable; said power cable comprising:

an outer insulating sheath enclosing separate insulating sheaths of each said at least two power conducting elements;

said power cable located in a power cable passage for use;

said power cable passage in part formed as a recess in a primary clamping lever;

said primary clamping lever including a pressure plate;

said connector elements passing through said outer insulating sheath and respective said separate insulating sheaths of said at least two power conducting elements when said power cable is urged into cutting contact with said connector elements by rotation of a cam-lever acting on said pressure plate;

said cam-lever rotating from an initial position to a position in which each of said power conducting elements of said power cable are forced into contact with said connector elements.

2. The power outlet of claim 1 wherein said power cable is a three conductor element cable having an active conductor element, a neutral conductor element and an earthing conductor element wherein said conductor elements arranged side by side with said earthing conductor element flanked by said active and said neutral conductor elements.

3. The power outlet of claim 1 wherein said power outlet includes a housing comprising a front portion and a back portion wherein said front portion is provided with said sockets for receiving said power conducting pins of a said electrical appliance.

4. The power outlet of claim 1 wherein said connector elements comprise power conducting clips for engaging with said power conducting pins and wherein said connector elements further comprise rearwardly projecting connector blades.

5. The power outlet of claim 4 wherein said power outlet includes a cable guide, said cable guide including side portions for receiving there between a said power cable and slots in a base portion of said cable guide determining spacing of said rearward projecting connector blades, said spacing diverging from a first spacing of said connector blades for spacing of power conducting elements of a first cable specification to a second spacing for power conducting elements of a second cable specification.

6. The power outlet of claim 5 wherein said power conducting clips are supported in sockets provided on a chassis element of said power outlet, said rearward projecting connector blades of said power conducting clips arranged so as to pass through slots arranged side by side in a base portion of said chassis element.

7. The power outlet of claim 6 wherein said rearward projecting connector blades pass through respective said slots of said cable guide when said cable guide is located in said chassis element.

8. The power outlet of claim 4 wherein said rearward projecting connector blades are provided with insulation piercing points.

9. The power outlet of claim 6 wherein said cable guide is retained in one of at least two positions within said chassis element of said power outlet, wherein the at least two positions include a first position arranged so that spacing of said rearward projecting connector blades conforms to conductor spacing of said first cable specification and a second position arranged so that spacing of said rearward projecting connector blades conforms to conductor spacing of said second cable specification.

10. The power outlet of claim 9 wherein said cable guide is slidably adjustable between said first and second positions.

11. The power outlet of claim 6 wherein said side portions of said cable guide are flexibly connected to said base portion of said cable guide, retaining elements of said chassis element arranged so that spacing of said side portions adjacent said rearwardly projecting connector blades conforms to overall width of a said cable of either said first or said second cable specification in accordance with said first or second position of said cable guide in said chassis element.

12. The power outlet of claim 6 wherein said base portion of said cable guide moves relative said connector blades when said cable guide is moved from said first to said second position; movement of said base portion compensating for differences in thickness of said first and said second cable specification.

13. The power outlet of claim 6 wherein said chassis element is affixed to said front portion of said housing; said chassis element provided with hinge and snap-locking elements for engagement with complementary hinge and snap-locking elements of said back portion of said housing.

14. The power outlet of claim 3 wherein said back portion of said housing is provided with a pivoting cam lever, said cam lever pivoting from a first non pressure inducing position to a second pressure inducing position, wherein a cam portion of said cam lever forcing said power cable against said insulation piercing points of said rearward projecting connector blades to bring said blades into contact with respective conductor elements of said power cable.

15. A power outlet assembly for receiving at least one plug of a power cord, said power outlet assembly receiving power from a power cable, said power outlet assembly comprising:

a power cable locating passage and rearwardly projecting insulating cutting blades disposed within said power cable locating passage;

said power locating passage in part formed as a recess in a primary cable clamping lever;

said primary clamping lever including a pressure plate;

said assembly further including a cam-lever, rotation of said cam-lever acting on said pressure plate to force power conducting elements of said power cable into contact with cutting blades wherein axis of said primary clamping lever and said cam lever are parallel to an axis of said power cable in said power cable passage.

16. The assembly of claim 15 wherein said power cable is a three conductor power cable, said conductors comprising an active conductor, a neutral conductor and an earth conductor and wherein said conductors disposed side by side within an outer insulating sheath of said power cable and each of said conductors further enclosed within respective inner insulating sheaths.

17. The assembly of claim 15 wherein said primary clamping lever retains said power cable in said power cable passage when said primary clamping lever is rotated into a closed snap-locked position against a rear plate of said assembly.

18. The assembly of claim 15 wherein said primary clamping lever includes an integrally attached flexible pressure plate, said pressure plate arranged to lie against said power cable in said power cable passage when said primary clamping lever is rotated from a first open position to said snap-locked position against a rear plate of said assembly.

19. The assembly of claim 15 wherein a surface of said cam lever is progressively urged against said flexible pressure plate when said cam lever is rotated from a first open position to a snap-locked position relative said primary clamping lever, said surface driving said power cable against said rearward projecting blades so as to cause respective said blades to pierce through said outer insulating sleeve and respective ones of said active conductor, said neutral conductor and said earth conductor and respective said blades making electrical contact with said conductors.

* * * * *